United States Patent [19]

Sledge

[11] Patent Number: 4,892,208

[45] Date of Patent: Jan. 9, 1990

[54] CHILD-RESISTANT CLOSURE ASSEMBLY

[75] Inventor: Larry C. Sledge, Midlothian, Va.

[73] Assignee: Specialty Packaging Licensing Company, Wilmington, Del.

[21] Appl. No.: 245,639

[22] Filed: Sep. 19, 1988

[51] Int. Cl.[4] ..... B65D 55/02

[52] U.S. Cl. ..... 215/216; 215/225; 215/306

[58] Field of Search ..... 215/216, 217, 224, 225, 215/306, 355, DIG. 1

[56] References Cited

U.S. PATENT DOCUMENTS

| | | | |
|---|---|---|---|
| 4,257,561 | 3/1981 | McKinney | 215/216 X |
| 4,280,631 | 7/1981 | Lohrman | 215/216 X |
| 4,358,031 | 11/1982 | Lohrman | 215/216 X |
| 4,807,768 | 2/1989 | Gach | 215/216 |

*Primary Examiner*—Stephen Marcus

*Assistant Examiner*—Christine A. Peterson

*Attorney, Agent, or Firm*—Dallett Hoopes

[57] ABSTRACT

Closure assembly includes a lid carrier or base having a hinged lid. The top wall of the lid carrier has a sealing means surrounded by a downward alignment sleeve. The assembly is especially useful with high-speed automatic container-capping machinery, because the sleeve cooperates with the cylindrical upright neck or spout on a container to see that the closure assembly is not cocked prior to sealing and that the top of the spout makes square contact with the sealing means to assure a good seal. The sleeve is interrupted on the opposite side of the carrier from the hinge so that it does not interfere with action of a latch depending from the lid. The spout itself forms a stop for the latch so that it will not be overextended and break when it is pressed in unlatching.

5 Claims, 1 Drawing Sheet

CHILD-RESISTANT CLOSURE ASSEMBLY

BACKGROUND OF THE INVENTION

1. Field of the Invention

This invention relates to a closure assembly. More particularly, this invention relates to a child-resistant dispensing closure useful on containers of liquids or gels and the like. On its top wall the assembly has sealing means surrounded by an alignment sleeve which aligns the sealing means with the top of a container spout and prevents cocking of the closure while it is screwed onto the container after filling. This enhances the consistency and quality of the seal and makes the closure assembly especially suitable for screwing onto a container by high-speed capping machinery.

2. Description of Related Art Including Information Disclosed Under §§1.97-1.99

There have been in the past dispensing assemblies comprising a lid and a lid carrier, the carrier, for instance, having threads to enage the threaded mouth of a plastic bottle. Examples are found in U.S. Pat. No. 4,127,221, issued Nov. 28, 1978 to Mary A. Vere, and U.S. Pat. No. 4,533,058, which issued Aug. 6, 1985 to Albert P. Uhlig. Various means are provided in these patents to make them difficult for children to open.

Another closure assembly is diclosed in U.S. Pat. No. 4,244,495, which issued Jan. 13, 1981 To Willy Lorscheid et al. In this patent the lid has a downward latch which may be unlatched by either shifting the lid on its hinge so that the latch clears its catching ledge, or pressing inward a portion of the carrier itself to flex the latch towards the hinge without moving the lid. When the latch is so flexed, it clears its catching ledge and the lid may be raised. The lid carrier of Lorscheid is formed with a downward sleeve which sealingly engages the inside of the neck of a container. Similar sealing sleeves are also noted in Vere and Uhlig.

One of the problems with the closure assemblies of the prior art is that when they are applied to a container by high-speed filling equpment, there is occasional misalignment or cocking of the closure and the container. When the closure is misaligned with the container, any effort by the machinery to screw the closure onto the container exacerbates the problem and results in poor seals or "leakers." It can also result in a jamming and a shutdown of the machinery until the unit which is the cause of the problem can be cleared out of the machine.

This problem can be well imagined reviewing the art cited above, which invariably involves a seal having a tapered outer edge adapted to wedge into the top of the container. It can be well imagined that such a closure, when seated on top of the container neck, can become canted at the tapered surface, with the consequent problem described above.

SUMMARY OF THE INVENTION

Under the present invention the closure is provided inside its threaded side wall with an integral downward alignment sleeve concentric with the closure. The alignment sleeve receives the cylindrical spout of the container such as a bottle before the threads on the closure engage the threads on the bottle, because, in order for the threads to engage, the alignment sleeve has to be over and aligned with the container spout. The closure has to be in proper alignment before the screwing down of the closure onto the container commences. Such proper alignments assure the consistency and quality of the seal because the sealing surfaces of the closure and container are "controlled"; i.e. centered and square prior to sealing. Cap cocking is prevented.

In the earlier references including threaded lid carriers, there is no sleeve for the purpose of aligning the lid before the threads are actually engaged. Instead, the references show seals which do not engage the bottle neck until the threads are substantially engaged.

An additional feature of the invention is that the alignment sleeve is interrupted in the area of the safety latch so that it does not interfere with the action of the latch. At the same time, the cylindrical spout of the bottle forms a backstop suitable for limiting the inward travel of the latch to avoid overextending it.

BRIEF DESCRIPTION OF THE DRAWINGS

Further objects and features of the invention will be clear from the following specification and attached drawings, all of which disclose a nonlimiting embodiment of the invention. In the drawings.

DESCRIPTION OF THE PREPARRED EMBODIMENT

Figure 1:
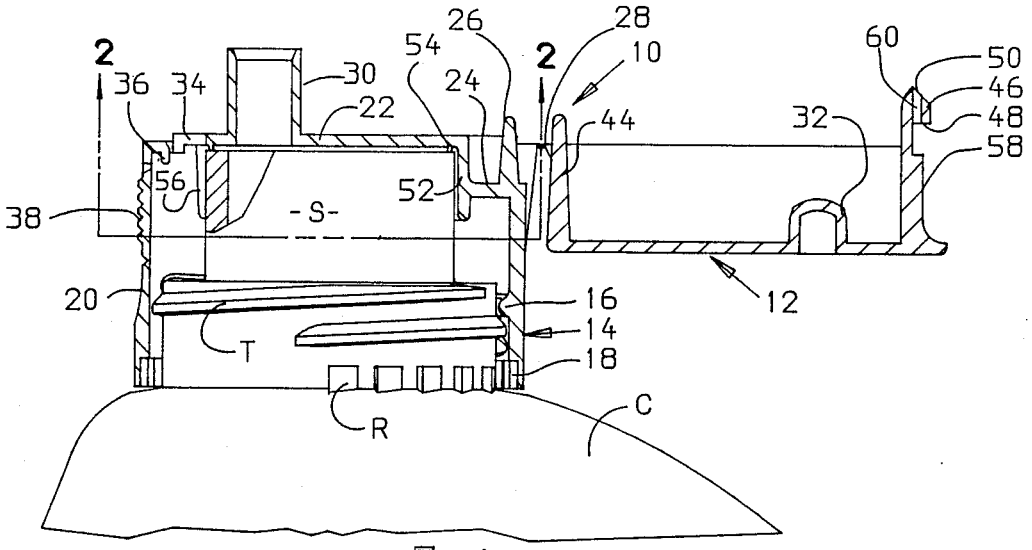
FIG. 1 is a sectional view of a closure assembly embodying invention in open condition and applied to a container which is only partially shown.

A closure assembly embodying the invention is shown in FIG. 1 and generally designated 10. It comprises a lid 12 and a cylindrical carrier 14 hinged thereto. They are integrally molded of resilient plastic. As shown, the inside of the lower end of the carrier is formed with threads 16 which engage the threads T on a container C.

To prevent removal of the closure assembly from the container C, the base of the threaded portion of the container is formed with rachets R engaged by mating ratchets 18 on the lid carrier. Thus, when the closure assembly 10 is screwed all the way onto the container C, the ratchets R and 18 engage and prevent counterclockwise removal of the assembly.

As shown, the container C is formed above the threaded area with a reduced generally cylindrical upward discharge spout S.

The lid carrier 14 comprises the cylindrical side wall 20 having a top wall 22 across its uppe end. The top wall is formed with a downward step 24 from which extends upward a resilient tongue 26. Outside the tongue 26 a hinge section 28 connects the carrier 14 to the lid 12.

The top wall 22 is formed with a tubular cylindrical upward dispensing orifice 30. Complementing this the lid 12 is formed with a plug 32 which fits into the orifice when the lid is closed. The top wall 22 of the lid carrier is formed with a generally rectangular integral latch opening 34 opposite the hinge 28. Under the outer margin of the opening 34 is provided a downward ledge 36, and a latch operator tab 38 is formed in the side wall 20 of the lid carrier 14. The tab 38 is defined by two spaced vertical slots 40 in the side wall 20 which are connected at their upper ends by a horizontal slot 42 to leave the tab 38 free to be flexed inward by thumb pressure, flexing about its connection 42A to the side wall at its lower end.

The lid 12 is formed adjacent the hinge with a cam 44 which cooperates with the upstanding tongue 26 in a manner well known from the aforementioned U.S. Pat. No. 4,244,495.

Figure 3:
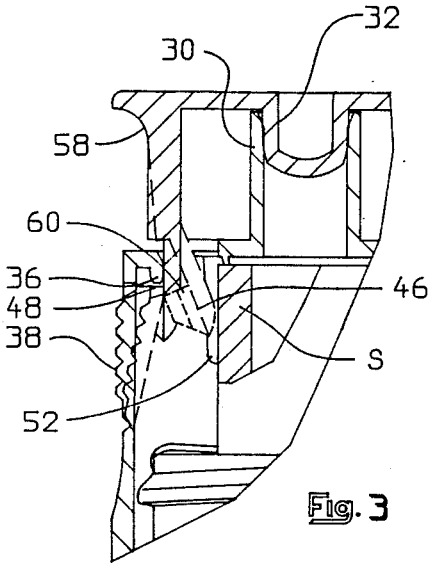
FIG. 3 is an enlarged fragmentary sectional elevational view showing the latch mechanism in the latched condition in solid lines and the unlatched condition in phantom.
Figure 4:
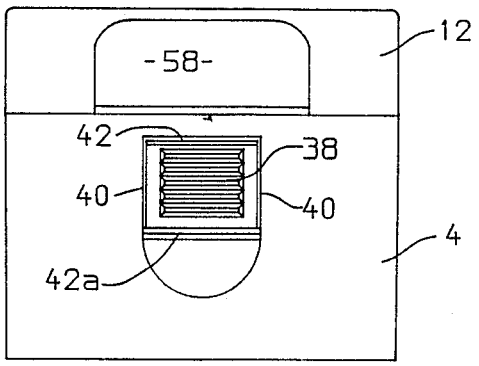
FIG. 4 is an elevational front view of the assembly in closed condition.

At the opposite end of the lid 12 from the cam 44 is the latch 46 formed as an integral extension of the side wall of the molded cup-shaped lid 32. The latch 46, integral with the side wall, has an undercut which provides a horizontal latching surface 48 so that when the lid is pivoted to its closed position, the latch enters the opening 34 and the latch flexes toward the hinge as the tapered leadin 50 of the latch engages the outward margin of the opening 34. When the latching surface 48 passes below the ledge 36, the latch snaps outwardly, latching the lid 12 in closed position. As shown in FIGS. 1 and 3, the latch 46 is formed with a vertical hole 60 which, when the latch is snapped, aligns with and is just below the downward ledge 36. Any attempt to lift lid 12 without depressing tab 38 will cause latch 46 to lock more resolutely with downward ledge 36 received into he opening 60 in latch 46. This is a "child-resistant" feature.

The underside of the top wall 22 of the lid carrier 14 is formed with a downward alignment sleeve 52 concentric with the side walls 20 of the lid carrier and spaced thereinside. This sleeve 52 is ample enough to just receive the spout S, as shown. The carrier preferably is "linerless"; that is, inside the alignment sleeve 52 the top wall 22 is formed with an integral crab-claw seal 54, well known in the art, sealing the top wall 22 to the top of the spout S.

Figure 2:
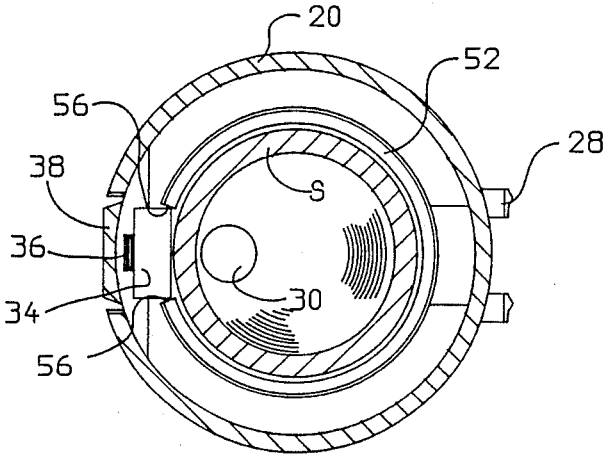
FIG. 2 is a sectional view taken on the line 2—2 of FIG. 1.

As shown in FIG. 2, the alignment sleeve 52 is interrupted as at 56 at the margin of the opening 34.

As shown in FIG. 3, the latch 46 may be flexed inward when the lid 12 is in the closed condition by thumb pressure on the latch operator tab 38. As shown, this flexes the latch 46 inward into the space between the interrupted ends of the alignment sleeve 52 until it contacts the cylindrical discharge spout S. Such contact with the spout S serves to limit the flexing of the latch 46 so that the latch 46 does not overextend and break. With the latch 46 in the flexed condition, the lid 12 may be raised with the fingers with the use of the convenient thumb recess 58 for the purpose.

Figure 5:
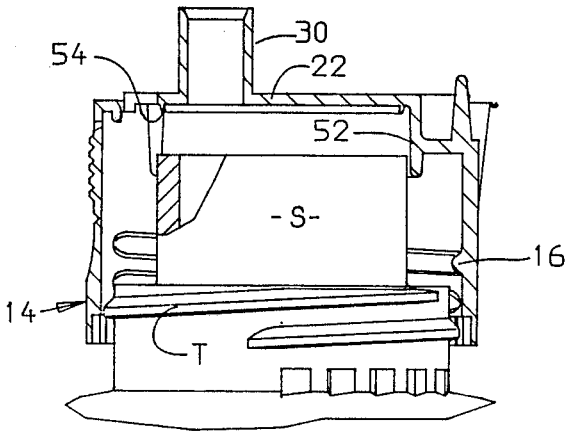
FIG. 5 is a view similar to FIG. 1 but showing the lid carrier with the lid broken away for simplicity and demonstrating how the alignment sleeve centers and squares the lid carrier with the spout prior to the engagement of the threads and prior to the sealing surfaces coming into contact with each other.

FIG. 5 demonstrates that the closure assembly of the invention, when placed on the container by the capping machinery, must have the upper end of the spou engage in the alignment means before the threads T and 16 can engage; that is, the spout and sleeve are together of sufficient length so that they begin to telescope before the threads engage. This assures that the closure will be screwed on straight.

Another important aspect of the invention of course is the provision of the alignment sleeve 52 in such a way that it does not interfere with the operation of the latching member 46. Thus, while the sleeve 52 has to be sizeable to accommodate the popular cylindrical spout S, the interruption 56 formed in the sleeve permits adequate flexing of the latch 46. At the same time, the spout S forms a backstop limiting the inward travel of the latching member 46 to avoid overextending it.

It should be understood that variations and reasonable modifications of structure embodying the invention are possible, and hence the invention is not limited to the embodiment shown, which is merely the preferred embodiment. The invention may be defined, therefore, in the following claim language and reasonable equivalents thereof.

What is claimed:

1. In combination, a container having a generally cylindrical upward dispensing spout and a concentric cylindrical enlargement at the base of the spout, the enlargement having threads about its side wall, and a cap having a top wall and a cylindrical side wall depending thereabout and having threads about the inside of the lower end thereof, the threads adapted to mate with the threads on the enlargement, the cap also having downward from the top wall an alignment sleeve concentric with the side wall and spaced thereinside, annular sealing means on the underside of the top wall inside the sleeve, the top wall of the cap being formed with a discharge orifice, the cap being provided with a hinged lid having a depending latch hook opposite the hinge, the top wall having a latch opening opposite the hinge adapted to lachingly receive the latch hook, a latch operator tab being formed on the side wall of the cap aligned with the latch when the lid is in the closed position, the sleeve being interrupted proximate the latch opening to avoid interference with the unlatching movement of the latch toward the hinge and the spout of the container forming a backstop for the latch hook, the sleeve adapted to fit closely over the outside of the spout on the container prior to the engagement of the mating threads, and thereby to prevent the cocking of the cap on the container and the assure proper square engagement of the spout with the sealing means.

2. In a closure assembly for a container having at its upper end a central elongated generally cylindrical upward discharge spout with threads at the base of the spout, the assembly comprising a generally cap-shaped lid carrier having interior threads at its lower end adapted to engage the container threads, the spout having an orifice through which contents of the container can be discharged, and a lid having a hinged connection with the lid carrier to be swingable to and from a closed position substantially overlying said lid carrier and blocking said orifice, said closur assembly being characterized by:

a. said lid having thereon a resilient latching member, said latching member
   (1) projecting downwardly from the lid as viewed when the lid is in said closed position,
   (2) being near the periphery of the lid at a location substantially opposite said hinge connection, and
   (3) having thereon a shoulder which projects away from the hinge connection and defines a surface that is spaced below the lid and faces toward the same;

b. said lid carrier having sealing means on the underside of its top wall and having thereon at a location which is near its periphery and substantially opposite said hinge connection, a radially inwardly projecting radial ledge under which said shoulder is releasably latchable to hold the lid in its closed position;

c. said lid carrier having a peripheral portion which (1) is opposite said hinge connection and (2) aligns with and overlies the hook-shaped latching member to be manually pressed inward to move the hook inward and unlatch it from the ledge so that the lid may be opened;

the improvement of the underside of the lid carrier being formed with an integral downward alignment sleeve outward from the sealing means concentric with and separate from the side wall of the lid carrier and having an inner diameter large enough to receive the spout of the container, the sleeve in combination with the spout adapted to guide the proper alignment of the closure assembly as it is screwed onto the container so that the top of the spout engages the sealing means squarely without cocking.

3. The closure assembly as claimed in claim 2 wherein the sleeve is continous except that it is interrupted in the area of the latching member so that the latching member may be moved inward without interference as the peripheral portion is moved in to unlatch the lid, the spout providing a limit to the inward travel of the latching member to avoid overextending the latching member.

4. A closure assembly as claimed in claim 2 wherein the sealing means comprises an annular crab-claw seal inward from the sleeve and engaging the top of the spout of the container.

5. A closure assembly as claimed in claim 2 wherein the spout of the container and sleeve of the carrier are together of such length that they begin to telescope before their threads engage.

* * * * *